US010595703B2

(12) United States Patent
Persson

(10) Patent No.: US 10,595,703 B2
(45) Date of Patent: Mar. 24, 2020

(54) METHOD OF DETERMINING WHETHER PROCESS WATER IS PRESENT IN A CIRCULATION PUMP OF AN APPLIANCE FOR WASHING AND RINSING GOODS, AND APPLIANCE AND COMPUTER PROGRAM THEREWITH

(71) Applicant: ELECTROLUX APPLIANCES AKTIEBOLAG, Stockholm (SE)

(72) Inventor: David Persson, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 142 days.

(21) Appl. No.: 15/772,214

(22) PCT Filed: Nov. 10, 2015

(86) PCT No.: PCT/EP2015/076184
§ 371 (c)(1),
(2) Date: Apr. 30, 2018

(87) PCT Pub. No.: WO2017/080588
PCT Pub. Date: May 18, 2017

(65) Prior Publication Data

US 2018/0310797 A1 Nov. 1, 2018

(51) Int. Cl.
*F04B 51/00* (2006.01)
*A47L 15/42* (2006.01)
(Continued)

(52) U.S. Cl.
CPC ..... *A47L 15/4244* (2013.01); *A47L 15/0023* (2013.01); *A47L 15/0049* (2013.01);
(Continued)

(58) Field of Classification Search
CPC ..... F04B 51/00; F04B 49/065; F04B 49/06; F04B 17/03; F04B 2201/0802;
(Continued)

(56) References Cited

U.S. PATENT DOCUMENTS 4,097,307 A 6/1978 Geiger
5,284,523 A 2/1994 Badami et al.
(Continued)

FOREIGN PATENT DOCUMENTS

CN 1 567 109 A 1/2005
CN 1 909 822 A 2/2007
(Continued)

OTHER PUBLICATIONS

Office Action for U.S. Appl. No. 14/439,351 dated May 16, 2018, 10 pages.
(Continued)

*Primary Examiner* — Andre J Allen
(74) *Attorney, Agent, or Firm* — Alston & Bird LLP

(57) ABSTRACT

Provided herein is a method of determining whether process water is present in a circulation pump of an appliance for washing and rinsing goods, and an appliance performing the method. The method of determining whether process water is present in a circulation pump of an appliance for washing and rinsing goods may include measuring a minimum value of a property representing load of the circulation pump at a predetermined first speed, measuring a maximum value of a property representing load of the circulation pump at a predetermined second speed, the second speed being higher than the first speed, determining a relation between said minimum value and said maximum value, and determining, from said relation, whether process water is present in the circulation pump.

19 Claims, 8 Drawing Sheets

(51) Int. Cl.

| | |
|---|---|
| ***A47L 15/00*** | (2006.01) |
| ***F04D 15/00*** | (2006.01) |
| ***F04D 15/02*** | (2006.01) |
| ***D06F 33/02*** | (2006.01) |
| ***D06F 39/08*** | (2006.01) |

(52) U.S. Cl.

CPC ..... *A47L 15/4225* (2013.01); *D06F 33/02* (2013.01); *D06F 39/085* (2013.01); *F04D 15/0088* (2013.01); *F04D 15/0236* (2013.01); *A47L 2401/08* (2013.01); *A47L 2401/14* (2013.01); *D06F 39/082* (2013.01); *D06F 2202/08* (2013.01); *D06F 2202/12* (2013.01); *D06F 2204/06* (2013.01); *D06F 2204/08* (2013.01); *F04D 15/0245* (2013.01)

(58) Field of Classification Search

CPC ..... F04B 49/10; F04B 13/00; F04B 19/22; F04B 2205/09; F04B 23/021; F04B 43/02; F04B 47/00; F04B 49/08; F04B 49/103; F04B 49/106; F04B 49/22; F04B 53/10; F04B 15/02; F04B 2201/0201; F04B 2201/0202; F04B 2201/0405; F04B 2201/0601; F04B 2201/1211; F04B 2203/0208; F04B 2203/0209; F04B 2205/04; F04B 2205/05; F04B 2205/13; F04B 2207/043; F04B 2207/701; F04B 2207/702; F04B 23/02; F04B 23/04; F04B 23/06; F04B 33/005; F04B 35/01; F04B 35/04; F04B 37/14; F04B 39/0292; F04B 39/08; F04B 39/10; F04B 39/1073; F04B 39/12; F04B 39/121; F04B 43/0081; F04B 43/073; F04B 43/0736; F04B 47/026; F04B 47/028; F04B 49/025; F04B 49/04; F04B 49/225; F04B 53/1082; F04B 53/14; F04B 53/144; F04B 53/16; F04B 5/02; F04B 7/0076; F04B 7/02; F04D 15/0088; F04D 13/086; F04D 13/12; F04D 15/0005; F04D 15/0227; F04D 27/001; F04D 13/068; F04D 13/14; F04D 15/0272; F04D 19/04; F04D 19/042; F04D 1/06; F04D 27/009; F04D 27/02; F04D 29/668; F04D 29/669; F04D 5/002

USPC ..... 73/168

See application file for complete search history.

(56) References Cited

U.S. PATENT DOCUMENTS

| | | | | |
|---|---|---|---|---|
| 5,330,580 | A | 7/1994 | Whipple, III et al. | |
| 6,655,922 | B1 | 12/2003 | Flek | |
| 6,887,318 | B2 | 5/2005 | Bashark | |
| 7,064,514 | B2 | 6/2006 | Iwaji et al. | |
| 7,064,517 | B2 | 6/2006 | Kiuchi et al. | |
| 7,241,347 | B2 | 7/2007 | Elick et al. | |
| 7,776,159 | B2 | 8/2010 | Hooker et al. | |
| 7,789,968 | B2 | 9/2010 | Elick et al. | |
| 8,295,984 | B2 | 10/2012 | Heisele et al. | |
| 8,439,052 | B2 | 5/2013 | Klein | |
| 9,872,597 | B2 | 1/2018 | Pers et al. | |
| 2001/0017145 | A1 | 8/2001 | Rosenbauer et al. | |
| 2003/0034749 | A1 | 2/2003 | Zinke et al. | |
| 2004/0099287 | A1 | 5/2004 | Shin | |
| 2005/0005952 | A1 | 1/2005 | Bashark | |
| 2006/0162438 | A1* | 7/2006 | Schofield | F04B 51/00 73/168 |
| 2006/0219262 | A1 | 10/2006 | Peterson et al. | |
| 2006/0237048 | A1 | 10/2006 | Weaver et al. | |
| 2007/0151579 | A1 | 7/2007 | Hooker et al. | |
| 2007/0163626 | A1 | 7/2007 | Klein | |
| 2007/0181156 | A1 | 8/2007 | Uz et al. | |
| 2010/0275953 | A1 | 11/2010 | Orue Orue et al. | |
| 2011/0038736 | A1 | 2/2011 | Hesterberg et al. | |
| 2011/0048459 | A1 | 3/2011 | Hesterberg et al. | |
| 2011/0126863 | A1 | 6/2011 | Kranzle et al. | |
| 2011/0286859 | A1* | 11/2011 | Ortiz | F04B 49/002 417/20 |
| 2012/0000535 | A1 | 1/2012 | Poyner et al. | |
| 2012/0006355 | A1 | 1/2012 | Heidel et al. | |
| 2012/0048302 | A1 | 3/2012 | Didat | |
| 2012/0048314 | A1 | 3/2012 | Vitan et al. | |
| 2012/0060874 | A1 | 3/2012 | Gnadinger et al. | |
| 2012/0266919 | A1 | 10/2012 | Kranzle et al. | |
| 2013/0048025 | A1 | 2/2013 | Heidel et al. | |
| 2014/0334945 | A1* | 11/2014 | Koehl | F04D 15/0088 417/44.11 |
| 2015/0305592 | A1 | 10/2015 | Pers et al. | |
| 2016/0002942 | A1* | 1/2016 | Orlando | F04B 49/065 700/282 |
| 2018/0283370 | A1* | 10/2018 | Slaby | F04B 49/20 |

FOREIGN PATENT DOCUMENTS

| | | | |
|---|---|---|---|
| DE | 197 50 266 | A1 | 5/1999 |
| DE | 10 2004 022 682 | B3 | 3/2006 |
| DE | 10 2007 041 313 | A1 | 3/2009 |
| DE | 10 2007 052 091 | A1 | 5/2009 |
| DE | 10 2008 020 475 | A1 | 11/2009 |
| DE | 10 2008 029 910 | A1 | 12/2009 |
| DE | 10 2011 000 287 | A1 | 7/2012 |
| DE | 10 2011 003 688 | A1 | 8/2012 |
| DE | 10 2014 105527 | B3 | 4/2015 |
| EP | 0326 893 | A2 | 8/1989 |
| EP | 1 112 016 | A1 | 7/2001 |
| EP | 1 284 540 | A2 | 2/2003 |
| EP | 1 574 161 | A1 | 9/2005 |
| EP | 1 737 332 | A1 | 1/2007 |
| EP | 2 213 217 | A1 | 8/2010 |
| EP | 2 248 935 | A1 | 11/2010 |
| EP | 2 407 078 | A2 | 1/2012 |
| EP | 2 609 845 | A1 | 7/2013 |
| EP | 2 672 875 | A1 | 12/2013 |
| JP | H 02 302239 | A | 12/1990 |
| JP | H 05 115414 | A | 5/1993 |
| JP | H 0819506 | A | 1/1996 |
| JP | 2006 006 766 | A | 1/2006 |
| JP | 2011 143 130 | A | 7/2011 |
| KR | 10-2012-0022427 | A | 3/2012 |
| WO | WO 2005/070275 | A1 | 8/2005 |
| WO | WO 2005/089621 | A1 | 9/2005 |
| WO | WO 2006/116433 | A1 | 11/2006 |
| WO | WO 2008/125482 | A2 | 10/2008 |
| WO | WO 2009/027371 | A1 | 3/2009 |
| WO | WO 2009/068391 | A1 | 6/2009 |
| WO | WO 2009/156326 | A2 | 12/2009 |
| WO | WO 2012/107264 | A1 | 8/2012 |
| WO | WO 2012/146599 | A2 | 11/2012 |
| WO | WO 2014/005650 | A1 | 1/2014 |
| WO | WO 2014/106801 | A1 | 7/2014 |

OTHER PUBLICATIONS

Notice of Allowance for U.S. Appl. No. 14/439,351 dated Nov. 15, 2018.

International Search Report and Written Opinion for PCT/EP2012/072204 dated Sep. 6, 2013, 9 pages.

International Search Report and Written Opinion for International Application No. PCT/EP2012/072203, dated Sep. 6, 2013, 12 pages.

International Search Report and Written Opinion for Application No. PCT/EP2015/077675 dated Aug. 16, 2016, 9 pages.

International Search Report and Written Opinion for Application No. PCT/EP2015/076184 dated Feb. 8, 2016, 13 pages.

Office Action for Chinese Application No. 201280076924.9 dated Oct. 10, 2016, 12 pages.

(56) References Cited

OTHER PUBLICATIONS

Office Action from corresponding European Patent Application No. 12805601.7 dated Sep. 23, 2016, 4 pages.
Office Action from corresponding European Patent Application No. 12805600.9 dated Feb. 10, 2017, 4 pages.
EPO machine translation of WO2005070275 retrieved from https://worldwide.espacenet.com/publicationDetails/biblio?CC=WO&NR=2005070275A1&KC=A1&FT=D&ND=3&date=20050804&DB=&locale=en_EP on Nov. 28, 2016.
*Brushless DC electric motor*—Wikipedia, the free encyclopedia [online] [retrieved Nov. 19, 2013]. Retrieved from the Internet: <URL: http://en.wikipedia.org/wiki/Brushless_DC_electric_motor>. 1 page.
Office Action from U.S. Appl. No. 14/439,351 dated Apr. 21, 2017.
Office Action for U.S. Appl. No. 14/439,351 dated Aug. 18, 2017.
Office Action for U.S. Appl. No. 14/439,346 dated Dec. 5, 2016.
Office Action for U.S. Appl. No. 14/439,346 dated Aug. 31, 2016.
Notice of Allowance for U.S. Appl. No. 14/439,346 dated Sep. 20, 2017.
International Search Report and Written Opinion for International Application No. PCT/EP2016/053132 dated Nov. 9, 2016.

* cited by examiner

METHOD OF DETERMINING WHETHER PROCESS WATER IS PRESENT IN A CIRCULATION PUMP OF AN APPLIANCE FOR WASHING AND RINSING GOODS, AND APPLIANCE AND COMPUTER PROGRAM THEREWITH

CROSS-REFERENCE TO RELATED APPLICATIONS

This application is a national stage application filed under 35 U.S.C. § 371 of International Application No. PCT/EP2015/076184 filed Nov. 10, 2015, which application is hereby incorporated by reference in its entirety.

TECHNICAL FIELD

The invention relates to a method of determining whether process water is present in a circulation pump of an appliance for washing and rinsing goods, and an appliance performing the method.

BACKGROUND

In a washing appliance such as a dishwasher, sensors are required for monitoring water levels in a compartment of the dishwasher, in particular when supplying water to the compartment via a dishwasher inlet to avoid an overflow situation, or simply to just monitor the approximate water level in the dishwasher.

Further, even if determination of a water level may not be required, it may still be desirable to detect whether there is process water present in a circulation pump of a dishwasher. In order to determine the presence of process water in the pump in the art, sensors such as e.g. flow sensors, pressure sensors, pressure switches, float switches, etc. are necessary. These sensors add to the complexity, and thus the cost, of the dishwasher.

SUMMARY

An object of the present invention is to solve, or at least mitigate, this problem in the art and to provide an improved method of determining whether process water is present in a circulation pump of an appliance for washing and rinsing goods.

This is attained in a first aspect of the invention by a method of determining whether process water is present in a circulation pump of an appliance for washing and rinsing goods. The method comprises measuring a minimum load of the circulation pump at a predetermined first speed, measuring a maximum load of the circulation pump at a predetermined second speed, the second speed being higher than the first speed, determining a relation between said minimum load and said maximum load, and determining, from said relation, whether process water is present in the circulation pump.

This is attained in a second aspect of the invention by an appliance for washing and rinsing goods. The appliance comprises a circulation pump, a sensing arrangement arranged to measure a minimum value of a property representing load of the circulation pump at a predetermined first speed, and a maximum value of a property representing load of the circulation pump at a predetermined second speed, the second speed being higher than the first speed. The appliance further comprises a controller arranged to control the speed of the circulation pump, and further to determine a relation between said minimum value and said maximum value, and determine, from said relation, whether process water is present in the circulation pump.

Advantageously, by determining a minimum value of a property representing load of the circulation pump at a predetermined first speed and a maximum value of a property representing load of the circulation pump at a predetermined higher second speed, for instance by measuring a property such as operating current of the pump as is performed in an embodiment, a relation, e.g. a difference, between the two can thus be determined. This difference is typically greater when process water is present in a volute of the circulation pump as compared to a situation where the pump is dry.

Hence, with the invention, it is advantageously determined whether process water is present in a circulation pump of an appliance for washing and rinsing goods, for instance a dishwasher, without using traditional sensors such as e.g. flow sensors, pressure sensors, pressure switches, float switches, etc.

In an embodiment of the invention, the minimum and maximum value of a property representing load of the circulation pump is advantageously measured by measuring a minimum value of operating current of the circulation pump at the lower predetermined speed, and a maximum value of operating current of the circulation pump at the higher predetermined speed.

Advantageously, as is done in an embodiment of the invention, a relation in the form of a difference is calculated between the minimum value and the maximum value, and then it is determined whether the calculated difference exceeds a predetermined threshold value. If so, process water is indicated to be present in the circulation pump.

In a further embodiment of the invention, a relation in the form of a quotient is calculated between the minimum value and the maximum value.

In an embodiment of the invention, in case the quotient is calculated by dividing a value representing maximum load with a value representing minimum load, it is determined whether the calculated quotient exceeds a predetermined threshold value. If so, process water is indicated to be present in the circulation pump.

In an alternative embodiment of the invention, in case the quotient is calculated by dividing a value representing minimum load at the lower speed with a value representing maximum load at the higher speed, it is determined whether the calculated quotient is below a predetermined threshold value. If so, process water is indicated to be present in the circulation pump.

In yet an embodiment, the load of the circulation pump is measured by measuring operating current of a motor driving the circulation pump. This may be measured indirectly by measuring the voltage of a known shunt resistor in the motor and calculating the current by using Ohm's law. Measured current can be directly translated into circulation pump torque; the higher the torque, the higher the operating current of the motor driving the pump, and a higher pump torque implies a greater flow of process water through the circulation pump. Measuring operating current of the circulation pump motor is in itself advantageous as compared to using a relatively expensive pressure or flow rate sensor to measure whether process water is present in the circulation pump.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description. The washing appliance of the invention will subsequently be exemplified by a dishwasher.

Figure 1:
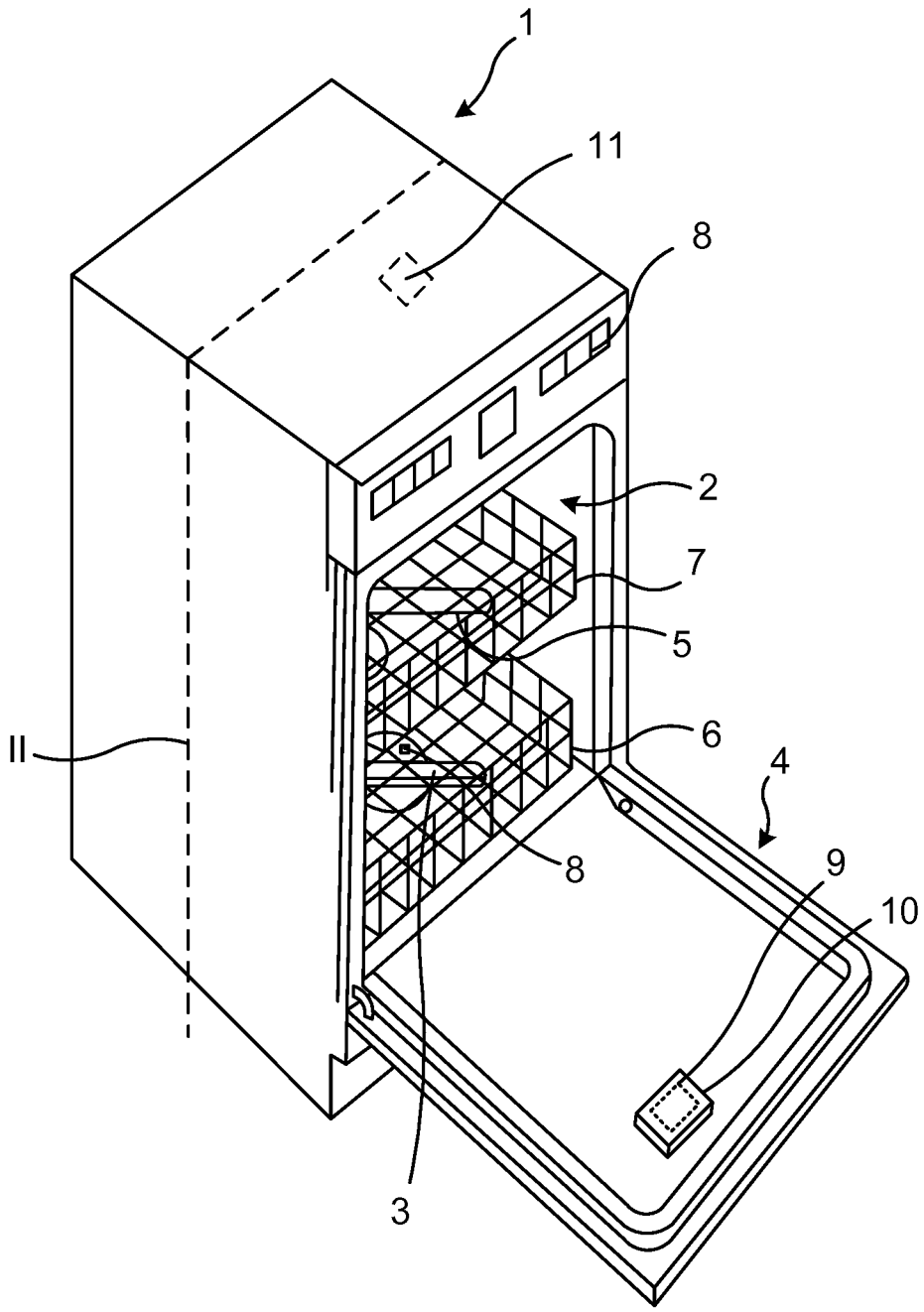
FIG. 1 shows a prior art dishwasher in which the present invention can be implemented.

FIG. 1 shows a prior art dishwasher 1 in which the present invention can be implemented. It should be noted that dishwashers can take on many forms and include many different functionalities. The dishwasher 1 illustrated in FIG. 1 is thus used to explain different embodiments of the present invention and should only be seen as an example of a dishwasher in which the present application can be applied.

The exemplifying dishwasher 1 comprises a washing compartment or tub 2, a door 4 configured to close and seal the washing compartment 2, a spraying system having a lower spray arm 3 and an upper spray arm 5, a lower rack 6 and an upper rack 7. Additionally, it may comprise a specific top rack for cutlery (not shown). A controller 11 such as a microprocessor is arranged in the interior of the dishwasher for controlling washing programmes and is communicatively connected to an interface 8 via which a user can select washing programmes.

The door 4 of the prior art dishwasher 1 illustrated in FIG. 1 is further on its inside arranged with a small detergent dispenser 9 having a lid 10 being controllably opened and closed by the controller 11 for dispensing detergent from the dispenser 9 into the tub 2.

Figure 2:
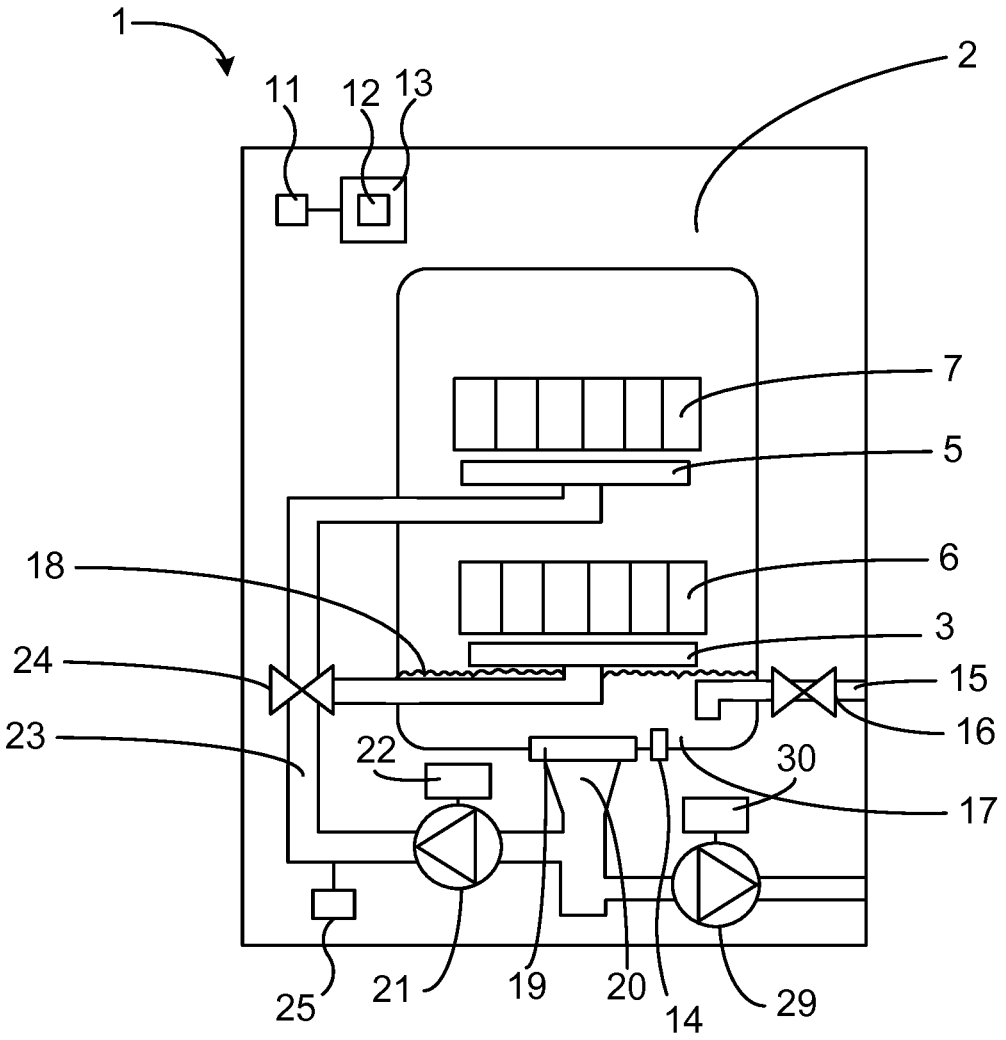
FIG. 2 schematically illustrates a cross-sectional view of the dishwasher of FIG. 1 taken along section II.

FIG. 2 schematically illustrates a cross-sectional view of the dishwasher 1 of FIG. 1 taken along section II, to further illustrate components included in a dishwasher 1. Hence, as previously mentioned, the dishwasher 1 comprises a washing compartment or tub 2 housing an upper basket 7 and a lower basket 6 for accommodating goods to be washed such as cutlery, plates, drinking-glasses, trays, etc.

Detergent in the form of liquid, powder or tablets is dosed in a detergent compartment located on the inside of a door (not shown in FIG. 2) of the dishwasher 1 by a user, which detergent is controllably discharged into the washing compartment 2 in accordance with a selected washing programme. As previously mentioned, the operation of the dishwasher 1 is typically controlled by the controller 11 executing appropriate software 12 stored in a memory 13.

Fresh water is supplied to the washing compartment 2 via water inlet 15 and water supply valve 16. This fresh water is eventually collected in a so called sump 17, where the fresh water is mixed with the discharged detergent resulting in process water 18. The opening and closing of the water supply vale 16 is typically controlled by the controller 11.

By the expression "process water" as used herein, is meant a liquid containing mainly water that is used in and circulates in a dishwasher. The process water is water that may contain detergent and/or rinse aid in a varying amount. The process water may also contain soil, such as food debris or other types of solid particles, as well as dissolved liquids or compounds. Process water used in a main wash cycle is sometimes referred to as the wash liquid. Process water used in a rinse cycle is sometimes referred to as cold rinse or hot rinse depending on the temperature in the rinse cycle. The pressurized fluid supplied to the detergent dispensing device according to embodiments of the invention thus at least partly contains process water.

At the bottom of the washing compartment is a filter 19 for filtering soil from the process water before the process water leaves the compartment via process water outlet 20 for subsequent re-entry into the washing compartment 2 through circulation pump 21. Thus, the process water 18 passes the filter 19 and is pumped through the circulation pump 21, which typically is driven by a brushless direct current (BLDC) motor 22, via a duct 23 and process water valve 24 and sprayed into the washing compartment 2 via nozzles (not shown) of a respective wash arm 3, 5 associated with each basket 6, 7. Thus, the process water 18 exits the washing compartment 2 via the filter 19 and is recirculated via the circulation pump 21 and sprayed onto the goods to be washed accommodated in the respective basket via nozzles of the wash arms 3, 5. Further, a controllable heater 14 is typically arranged in the sump 17 for heating the process water 18.

The washing compartment 2 of the dishwasher 1 is drained on process water 18 with a drain pump 29 driven by a BLDC motor 30. It should be noted that it can be envisaged that the drain pump 29 and the circulation pump 21 may be driven by one and the same motor.

In an embodiment of the invention, a sensing arrangement 25 is arranged at the circulation pump 21 for measuring load of the circulation pump 21, in the form of e.g. operating current, voltage or power. The sensing arrangement 25 may be implemented in the form of a resistor arranged at the circulation pump motor 22 for measuring operation current of the motor. Practically, this is undertaken by measuring the operating voltage of a known shunt resistor in the motor 22 of the circulation pump 21 and calculating the operating current.

Measured pump load in the form of for instance operating current can directly be translated into circulation pump torque for a given circulation pump speed; the higher the torque, the higher the operating current of the motor 22 driving the pump 21, and a higher pump torque implies a greater flow of process water 18 through the circulation pump.

Figure 3A:
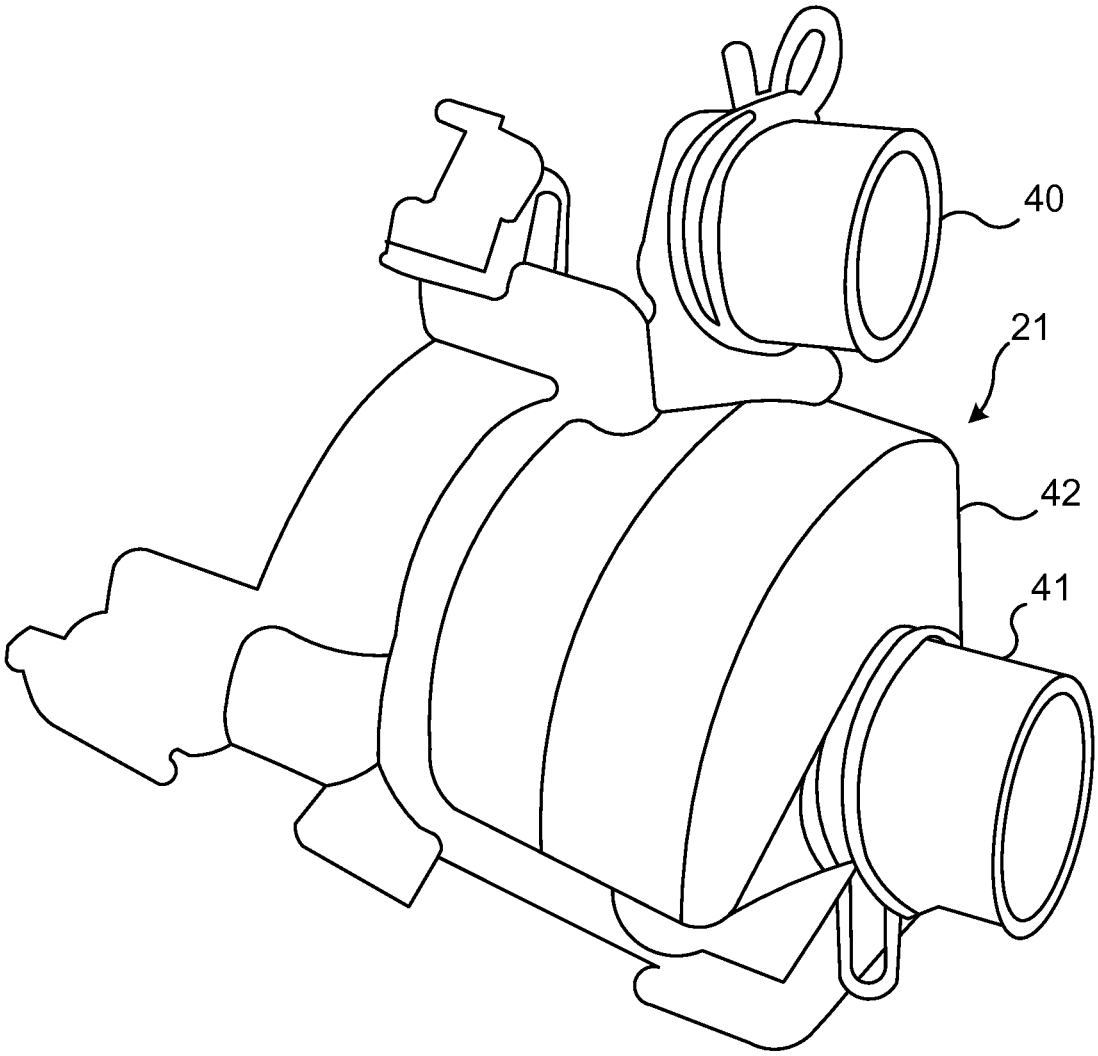
FIGS. 3*a* and *b* illustrate two different views of a circulation pump which can be controlled according to embodiments of the present invention.

FIG. 3*a* shows a view of an exemplifying circulation pump 21. The speed of the circulation pump 21 is typically controlled by the controller 11. FIG. 3*a* shows an outlet 40 (referred to as a discharge port) of the circulation pump 21 and an inlet 41. The casing 42 of the circulation pump 21 is referred to as the volute and can be removed from a main body 43 of the circulation pump 21.

Figure 3B:
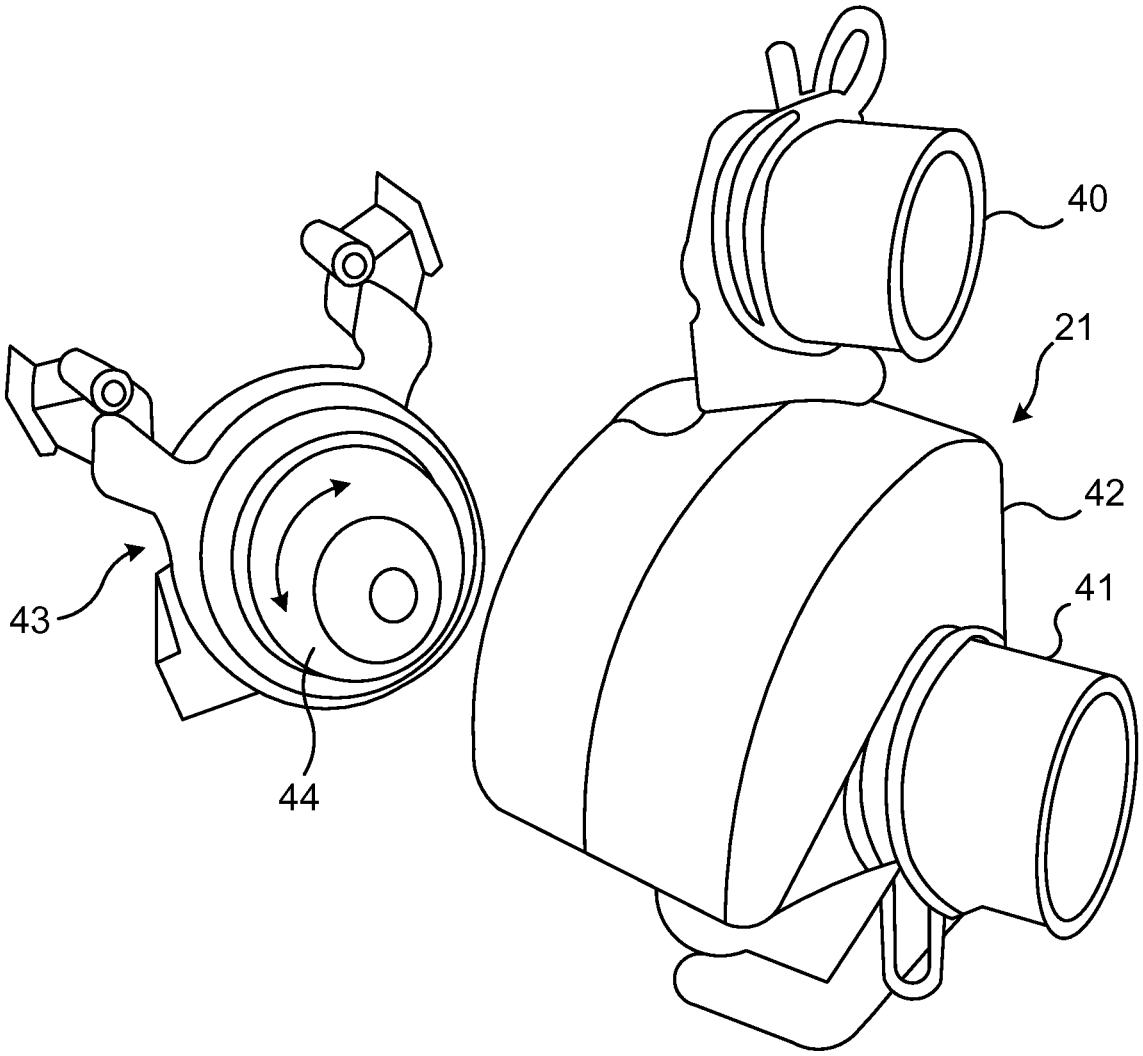

FIG. 3*b* shows a further view of the circulation pump 21 of FIG. 3*a*, where the volute 42 has been removed from the main body 43 of the circulation pump, thereby revealing the impeller 44 of the circulation pump which under operation pumps the process water that is entering the circulation pump 21 via the inlet 41. The process water that is pumped by the impeller 44 is subsequently received by the volute 42, which slows down the flow rate of the process water, and exits the circulation pump 21 via the outlet 40.

A method of determining whether process water 18 is present in the circulation pump 21 of the dishwasher 1 according to an embodiment of the invention will now be described in the following with reference to FIGS. 4-6. In this exemplifying embodiment, the load of the circulation pump is determined by measuring its operating current.

Figure 4:
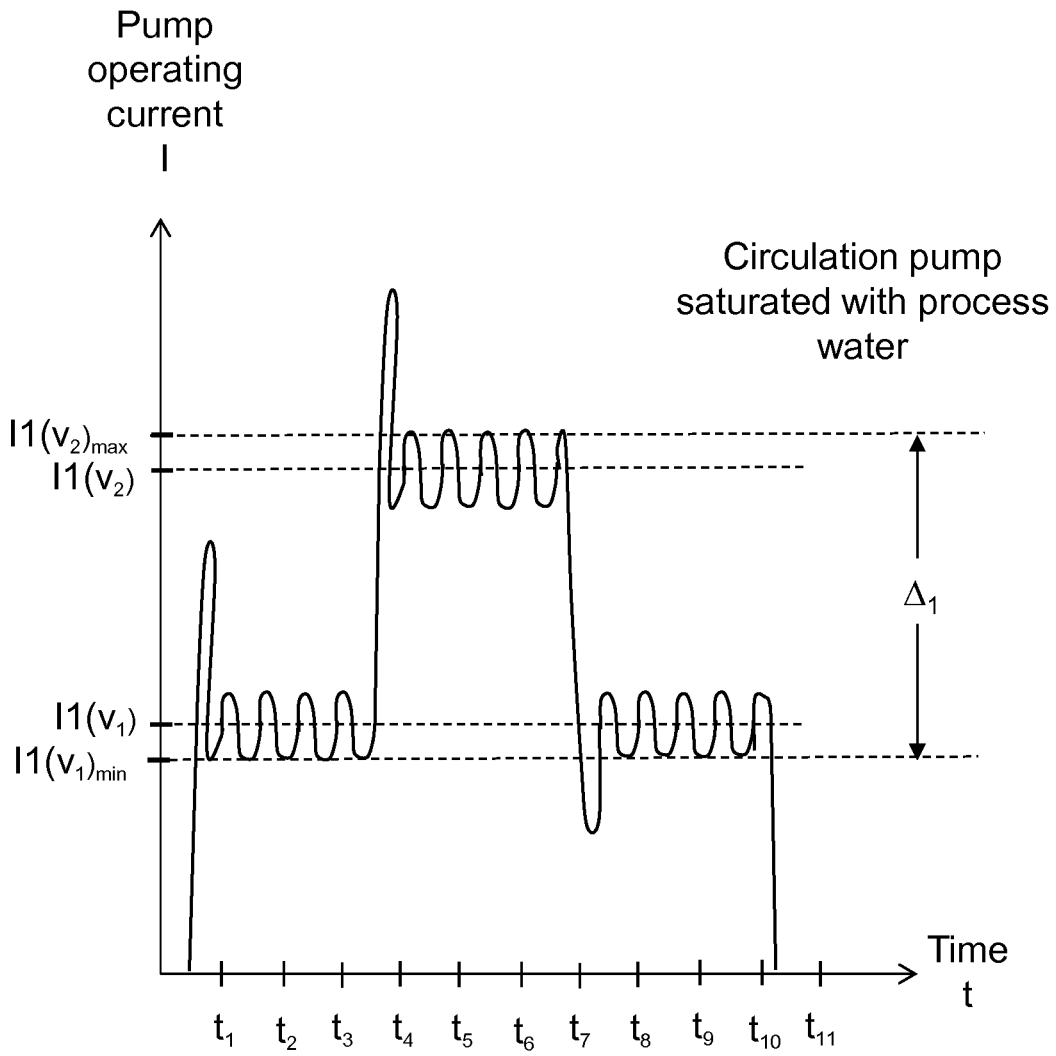
FIGS. 4-6 show three different scenarios of increasing circulation pump speed in order to measure pump load for determining presence of process water in the circulation pump according to the invention.

FIG. 4 illustrates a first scenario where a speed of the circulation pump is increased from a first speed $v_1$ to a second speed $v_2$ being higher than the first speed, while the operating current of the circulation pump is measured. Now, if process water 18 is present in the circulation pump 21, the impeller 44 of the pump 21 will set the water into motion and cause it to rotate in the volute 42 of the pump. FIG. 4 illustrates a situation where the pump is saturated with water.

Figure 5:
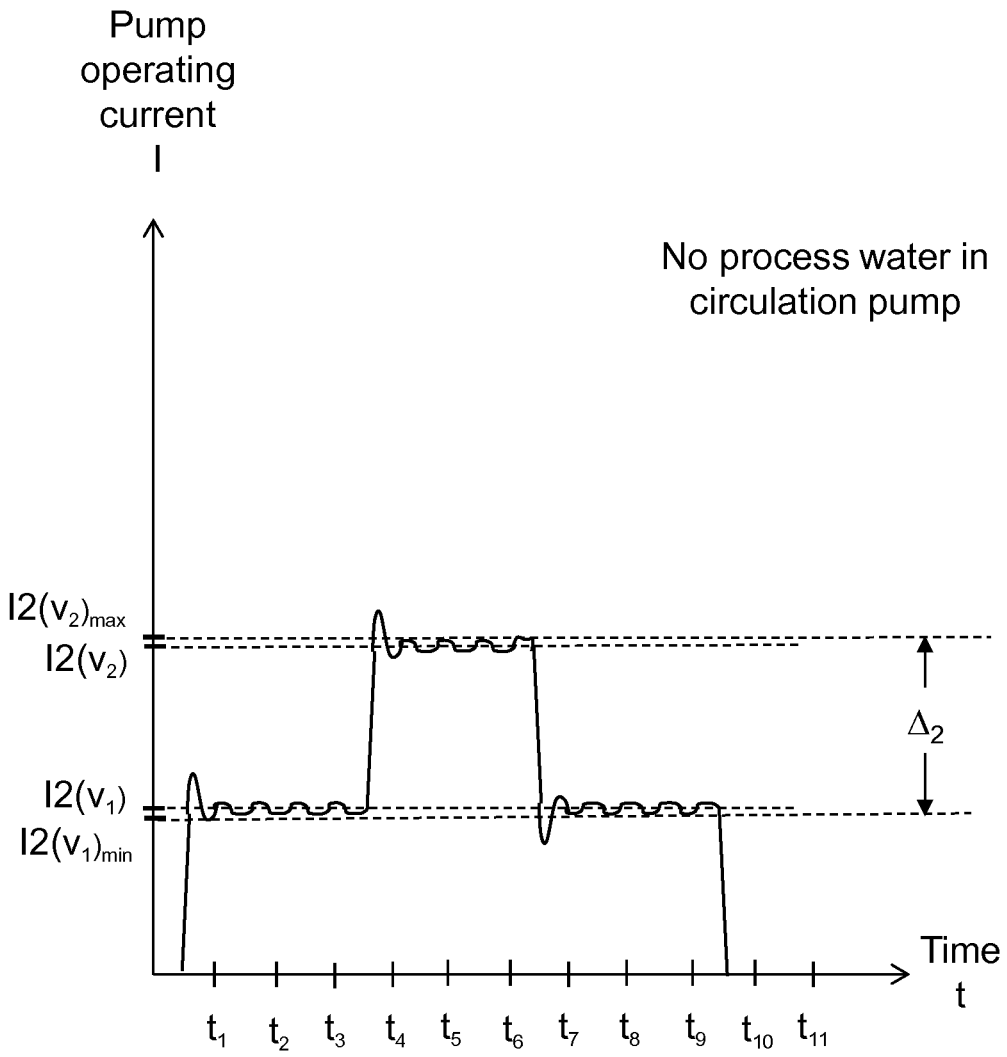

FIG. 5 illustrates a scenario when no process water 18 is present in the circulation pump 21. In this second scenario, the impeller 44 will not experience any process water load when the pump speed is changed from $v_1$ to $v_2$ (or vice versa).

Figure 6:
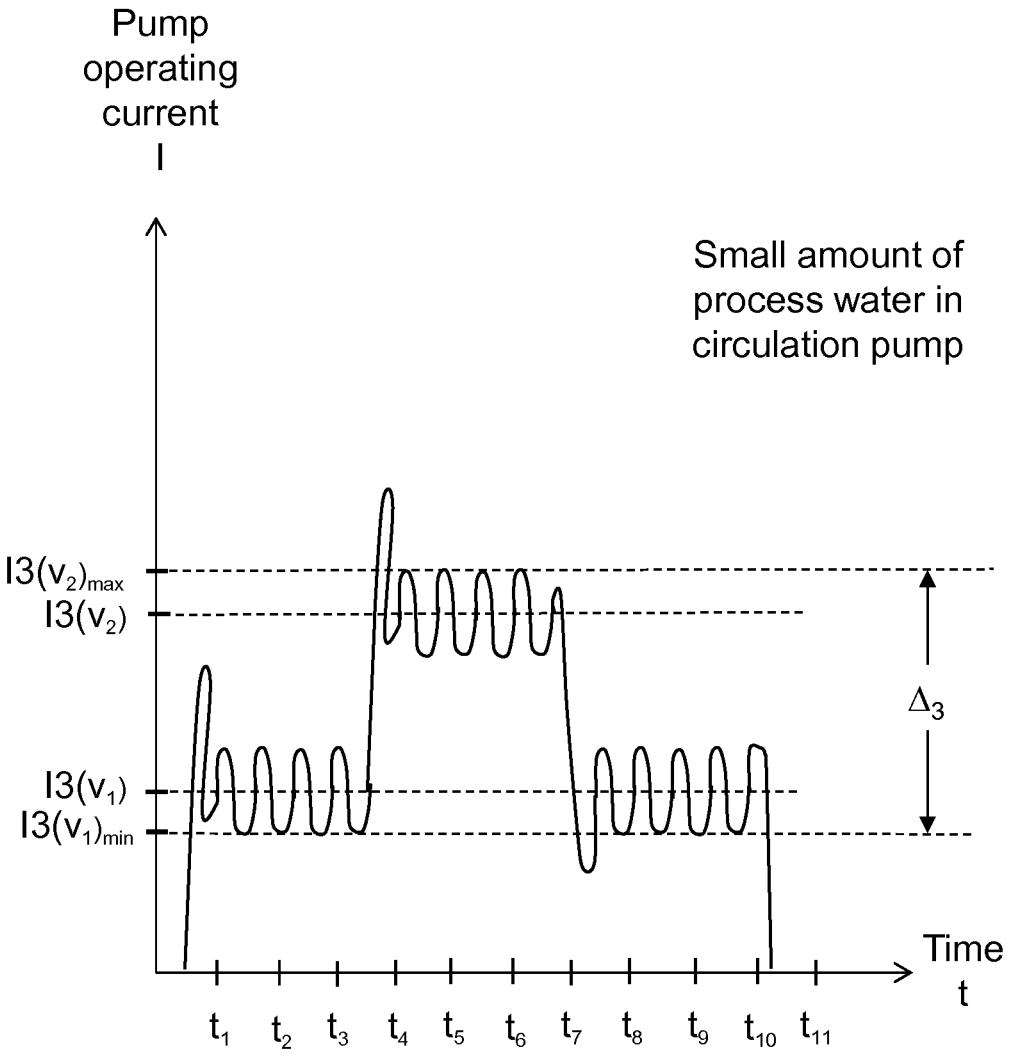

FIG. 6 illustrates a third scenario where just a small amount of process water 18 is present in the circulation pump 21. In this scenario, the impeller 44 will experience a slight process water load when the impeller 44 causes the process water to rotate in the pump volute 42.

In an embodiment, assuming e.g. that a relation $\Delta_n$ between maximum current $In(v_2)_{max}$ at the higher speed $v_2$ minimum current $In(v_1)_{min}$ at the lower speed $v_1$, where n denotes the respective scenario is calculated as:

$$\Delta_n = In(v_2)_{max} - In(v_1)_{min}$$

With reference to the three scenarios discussed throughout FIGS. 4-6, it can be concluded that:

$$\Delta_1 > \Delta_2, \text{ and}$$

$$\Delta_3 > \Delta_2.$$

Using exemplifying numerical values, for the second scenario when the pump is empty, the pump operating current is assumed to be:

$$I_2(v_2)_{max} = 205 \text{ mA, and}$$

$$I_2(v_1)_{min} = 95 \text{ mA.}$$

Thus, in this particular embodiment, $\Delta_2 = 205 - 95 = 110$.

Further, it is assumed that for the first and the third scenario:

$$I_1(v_2)_{max} = 325 \text{ mA,}$$

$$I_1(v_1)_{min} = 130 \text{ mA, } \Rightarrow \Delta_1 = 325 - 130 = 195,$$

$$I_3(v_2)_{max} = 240 \text{ mA,}$$

$$I_3(v_1)_{min} = 85 \text{ mA, } \Rightarrow \Delta_3 = 240 - 85 = 155.$$

Hence, in this particular exemplifying embodiment, by measuring pump operating currents at two defined pump speeds $v_1$, $v_2$ for these three different scenarios, for instance during production of the dishwasher, it can advantageously be determined during normal operation whether there is process water present in the pump or not.

In an embodiment, a threshold value of e.g. T=120 is used, and if the measured difference Δ exceeds the predetermined threshold value T, the pump is considered to comprise water.

In the scenarios of FIGS. 4-6, $\Delta_1 = 195 > \Delta_3 = 155 > T = 120$, while $\Delta_2 = 110 < T$, and it can be concluded that for the scenarios in FIGS. 4 and 6, the pump contains water, while in the second scenario the pump is considered to not contain water.

Figure 7:
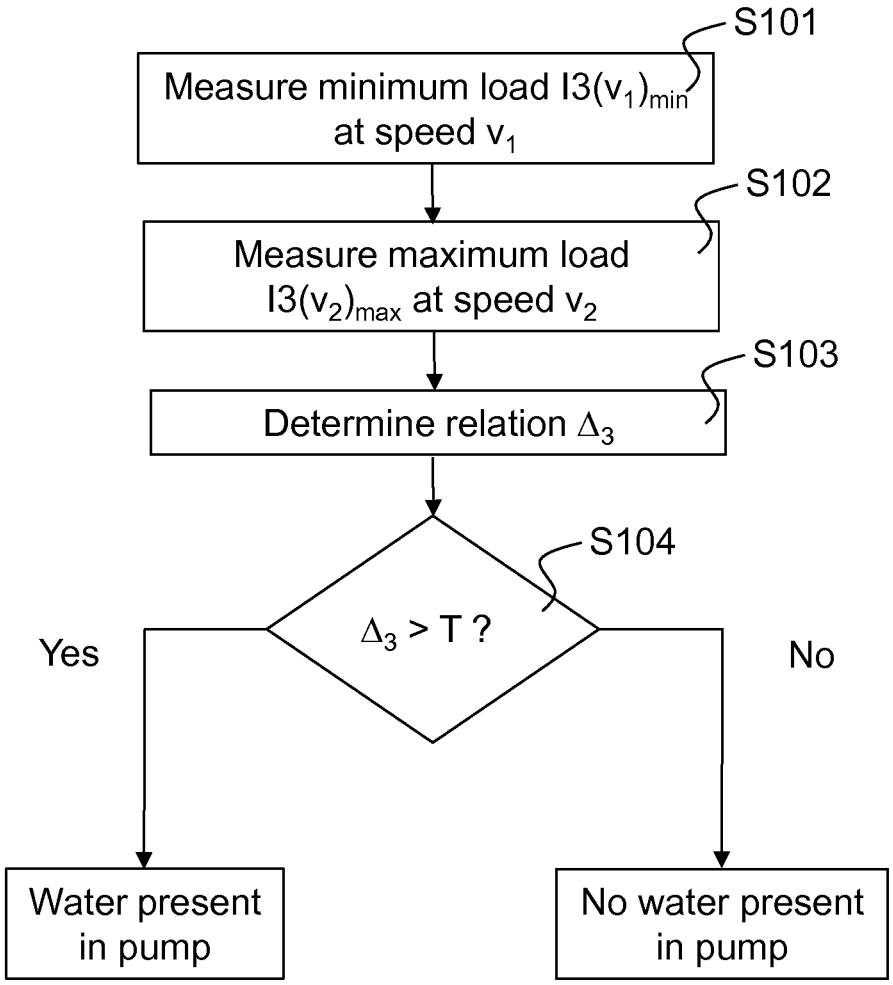
FIG. 7 shows a flowchart illustrating an embodiment of a method of determining presence of process water in the circulation pump according to the invention.

FIG. 7 illustrates a flowchart of an embodiment of the method of determining whether process water is present in a circulation pump of a dishwasher. Reference will further be made to FIG. 6, which is the envisaged scenario in this exemplifying embodiment.

Hence, in a first step S101 a minimum load of the circulation pump is measured at a predetermined first speed $v_1$. This is undertaken by measuring minimal operating current $I_3(v_1)_{min}$ at the first speed $v_1$. Then, the speed of the pump is raised in step S102 to the second speed $v_2$, where a maximum load, i.e. a maximum operating current $I_3(v_2)_{max}$, is measured.

As previously has been discussed, a relation between the minimum pump load at the lower speed $v_1$ and the maximum pump load at the higher speed $v_2$ is determined in step S103. In this particular embodiment, the difference $\Delta_3 = I_3(v_2)_{max} - I_3(v_1)_{min}$ is determined, and from this difference it is concluded in step S104 whether process water is present in the circulation pump or not.

In this example, $\Delta_3 = 155$, while the predetermined threshold value T=130. Hence, $\Delta_3 > T$, and process water is thus present in the circulation pump.

It is noted that steps S101 and S102 can be reversed in the method; it does not matter whether the maximum load is measured before the minimum load, or vice versa.

In a further embodiment, the relation between the minimum circulation pump load at the first speed $v_1$ and the maximum circulation pump load at the second speed $v_2$ is calculated as a quotient:

$$q_n = \frac{In(v_2)_{max}}{In(v_1)_{min}}$$

For the three scenarios in FIGS. 4-6, this would result in:

$$q_1 = \frac{325}{130} = 2.50,\ q_2 = \frac{205}{95} = 2.16,\ q_3 = \frac{240}{85} = 2.82$$

In such an embodiment, the predetermined threshold value may be set to e.g. T=2.2.

Thus, for any measurement where q>T, the pump is considered to contain water.

In still a further embodiment, the relation between the minimum circulation pump load at the first speed $v_1$ and the maximum circulation pump load at the second speed $v_2$ is calculated as:

$$p_n = \frac{In(v_1)_{min}}{In(v_2)_{max}}$$

that is p=1/q.

For the three scenarios in FIGS. 4-6, this would result in:

$$p_1 = \frac{130}{325} = 0.40,\ q_2 = \frac{95}{205} = 0.46,\ q_3 = \frac{85}{240} = 0.35$$

In such an embodiment, the predetermined threshold value may be set to e.g. T=0.45.

Thus, for any measurement where p<T, the pump is considered to contain water.

In practice, the steps of the method performed by the dishwasher 1 according to embodiments of the invention is caused by the controller 11 embodied in the form of one or more microprocessors or processing units arranged to execute a computer program 12 downloaded to a suitable storage medium 13 associated with the microprocessor, such as a Random Access Memory (RAM), a Flash memory or a hard disk drive. The controller 11 is arranged to cause the dishwasher 1 to carry out at the steps of the method according to embodiments of the present invention when the appropriate computer program 12 comprising computer-executable instructions is downloaded to the storage medium 13 and executed by the controller 11. The storage medium 13 may also be a computer program product comprising the computer program 12. Alternatively, the computer program 12 may be transferred to the storage medium 13 by means of a suitable computer program product, such as a Digital Versatile Disc (DVD) or a memory stick. As a further alternative, the computer program 12 may be downloaded to the storage medium 13 over a network. The controller 11 may alternatively be embodied in the form of a digital signal processor (DSP), an application specific integrated circuit (ASIC), a field-programmable gate array (FPGA), a complex programmable logic device (CPLD), etc.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A method of determining whether process water is present in a circulation pump of an appliance for washing and rinsing goods, comprising:

measuring a minimum value of a property representing load of the circulation pump at a predetermined first speed ($v_1$);

measuring a maximum value of a property representing load of the circulation pump at a predetermined second speed ($v_2$), the second speed being higher than the first speed;

determining a relation between said minimum value and said maximum value; and determining, from said relation, whether process water is present in the circulation pump.

2. The method of claim 1, the measuring of the minimum and maximum value comprising:

measuring a minimum value of operating current ($I(v_1)_{min}$) of the circulation pump at the predetermined first speed ($v_1$); and measuring a maximum value of operating current ($I(v_2)_{max}$) of the circulation pump at the predetermined second speed ($v_2$).

3. The method of claim 1, the determining of the relation between said minimum value and said maximum load comprising:

calculating a difference (Δ) between said minimum value and said maximum value.

4. The method of claim 3, the determining whether process water is present in the circulation pump comprising:

determining whether the calculated difference (Δ) exceeds a predetermined threshold value (T), wherein process water is indicated to be present in the circulation pump.

5. The method of claim 1, the determining of the relation between said minimum value and said maximum value comprising:

calculating a quotient (p, q) between said minimum value and said maximum value.

6. The method of claim 5, the quotient (q) being calculated by dividing the value representing maximum load with the value representing minimum load; the determining whether process water is present in the circulation pump comprising:

determining whether the calculated quotient (q) exceeds a predetermined threshold value (T), wherein process water is indicated to be present in the circulation pump.

7. The method of claim 5, the quotient (p) being calculated by dividing the value representing minimum load with the value representing maximum load; the determining whether process water is present in the circulation pump comprising:

determining whether the calculated quotient (p) is below a predetermined threshold value (T), wherein process water is indicated to be present in the circulation pump.

8. An appliance for washing and rinsing goods, comprising:

a circulation pump;

a sensing arrangement arranged to measure a minimum value of a property representing load of the circulation pump at a predetermined first speed ($v_1$), and a maximum value of a property representing load of the circulation pump at a predetermined second speed ($v_2$), the second speed being higher than the first speed;

a controller arranged to control the speed of the circulation pump, wherein the controller further is arranged to determine a relation between said minimum value and said maximum value; and determine, from said relation, whether process water is present in the circulation pump.

9. The appliance of claim 8, the sensing arrangement further being arranged to, when measuring the minimum and maximum value:

measure a minimum value of operating current ($I(v_1)_{min}$) of the circulation pump at the predetermined first speed ($v_1$); and measure a maximum value of operating current ($I(v_2)_{max}$) of the circulation pump at the predetermined second speed ($v_2$).

10. The appliance of claim 8, the controller further being arranged to, when determining the relation between said minimum value and said maximum value comprising:

calculating a difference (Δ) between said minimum value and said maximum value.

11. The appliance of claim 10, the controller further being arranged to, when determining whether process water is present in the circulation pump:

determine whether the calculated difference (Δ) exceeds a predetermined threshold value (T), wherein process water is indicated to be present in the circulation pump.

12. The appliance of claim 8, the controller further being arranged to, when determining the relation between said minimum value and said maximum value:

calculate a quotient (p, q) between said minimum value and said maximum value.

13. The appliance of claim 12, the controller further being arranged to:

calculate the quotient (q) by dividing the value representing maximum load with the value representing minimum load; and further to, when determining whether process water is present in the circulation pump:

determine whether the calculated quotient (q) exceeds a predetermined threshold value (T), wherein process water is indicated to be present in the circulation pump.

14. The appliance of claim 12, the controller further being arranged to:

calculate the quotient (p) by dividing the value representing minimum load with the value representing maximum load; and further to, when determining whether process water is present in the circulation pump:

determine whether the calculated quotient (p) is below a predetermined threshold value (T), wherein process water is indicated to be present in the circulation pump.

15. The appliance of claim 8, the sensing arrangement being arranged to measure the value of a property representing circulation pump load by measuring a value of operating current of a motor driving the circulation pump.

16. The appliance of claim 15, wherein the sensing arrangement comprises:

a resistor arranged at the motor driving the circulation pump, through which resistor the operating current of the motor is measured.

17. A computer program comprising computer-executable instructions for causing a device to perform steps recited in claim 1 when the computer-executable instructions are executed on a processing unit included in the device.

18. A computer program product comprising a computer readable medium, the computer readable medium having the computer program according to claim 17 embodied thereon.

19. The appliance of claim 8, said appliance comprising a dish washer or a washing machine.

* * * * *